US007963838B2

(12) United States Patent
Gauselmann

(10) Patent No.: US 7,963,838 B2
(45) Date of Patent: Jun. 21, 2011

(54) BONUS GAME FOR GAMING MACHINE PROVIDING PLAYER WITH DEAL OR NO DEAL OPTIONS

(75) Inventor: Michael Gauselmann, Espelkamp (DE)

(73) Assignee: Atronic International GmbH, Lübbecke (DE)

( * ) Notice: Subject to any disclaimer, the term of this patent is extended or adjusted under 35 U.S.C. 154(b) by 1733 days.

(21) Appl. No.: 10/754,197

(22) Filed: Jan. 9, 2004

(65) Prior Publication Data

US 2005/0153767 A1 Jul. 14, 2005

(51) Int. Cl.
*A63F 9/24* (2006.01)

(52) U.S. Cl. ..... 463/16; 463/9; 463/20; 463/25; 463/37

(58) Field of Classification Search ..... 463/16, 463/20, 25, 30, 31, 37, 43, 9
See application file for complete search history.

(56) References Cited

U.S. PATENT DOCUMENTS

| | | | | |
|---|---|---|---|---|
| 5,531,440 | A * | 7/1996 | Dabrowski et al. | 463/12 |
| 5,788,573 | A * | 8/1998 | Baerlocher et al. | 463/16 |
| 5,807,172 | A * | 9/1998 | Piechowiak | 463/20 |
| 5,947,820 | A * | 9/1999 | Morro et al. | 463/9 |
| 6,159,097 | A * | 12/2000 | Gura | 463/20 |
| 6,375,187 | B1 * | 4/2002 | Baerlocher | 273/143 R |
| 6,439,995 | B1 * | 8/2002 | Hughs-Baird et al. | 463/20 |
| 6,464,582 | B1 * | 10/2002 | Baerlocher et al. | 463/20 |
| 6,506,118 | B1 * | 1/2003 | Baerlocher et al. | 463/25 |
| 6,514,141 | B1 * | 2/2003 | Kaminkow et al. | 463/25 |
| 6,632,141 | B2 * | 10/2003 | Webb et al. | 463/25 |
| 6,889,978 | B2 * | 5/2005 | Schaefer et al. | 273/139 |
| 2002/0025843 | A1 * | 2/2002 | Bryant | 463/16 |
| 2002/0142822 | A1 * | 10/2002 | Baerlocher et al. | 463/16 |
| 2002/0187827 | A1 * | 12/2002 | Blankstein | 463/20 |
| 2003/0064770 | A1 | 4/2003 | Kaminkow et al. | |
| 2003/0216167 | A1 | 11/2003 | Gauselmann | |

(Continued)

FOREIGN PATENT DOCUMENTS

GB 2 119 989 A 11/1983

OTHER PUBLICATIONS

"Miljoenenjacht (Netherlands)", http://en.wikipedia.org/wiki/Miljoenenjacht_(Netherlands).*

(Continued)

*Primary Examiner* — Dmitry Suhol
*Assistant Examiner* — Brandon Gray
(74) *Attorney, Agent, or Firm* — Patent Law Group LLP; Brian D. Ogonowsky

(57) ABSTRACT

In one embodiment, a gaming machine carries out a main game which initiates a bonus game for a certain outcome of the main game. In one embodiment, the bonus game displays a plurality of hidden objects in the form of icons. The objects may be credits, money, letters, symbols, or anything else. The player chooses one or more options, and the hidden values for the selected options are revealed to the player. The player's goal is to obtain the highest value amount by, for example, choosing the highest value icon, or by spelling words from accumulated letters, or by accumulating symbols. After each selection by the player, the gaming machine offers the player a value (e.g., a number of credits) to end the bonus game. The player may accept the offer or continue playing the bonus game to its conclusion.

17 Claims, 14 Drawing Sheets

U.S. PATENT DOCUMENTS

| | | | | |
|---|---|---|---|---|
| 2004/0053660 | A1 * | 3/2004 | Webb et al. | 463/16 |
| 2004/0053665 | A1 * | 3/2004 | Baerlocher | 463/16 |

OTHER PUBLICATIONS

"(Big) Money Game", http://gscentral.net/money.htm.*

"Deal or No Deal (AUS 2003)—Australian Game Show Home Page," http://www.sub.net.au/~powney/gameshow/dealnodeal2003.htm, downloaded by applicant on Dec. 9, 2003.*

Powney, C. Deal or No Deal (AUS) (2003). Australian Game Show Home Page [online], Dec. 17, 2003 [retrieved on Jun. 19, 2007]. Retrieved from the Internet: <URL: http://web.archive.org/web/20031217171706/http://www.sub.net.au/~powney/gameshow/dealnodeal2003.htm>.*

European Search Report, 1 page.

Web page description of "Deal or No Deal" TV show, downloaded on Dec. 9, 2003 from http://www.sub.net.au/~powney/gameshow/dealnodeal2003.htm, pp. 1-2.

Web page description of "Deal or No Deal" TV show, downloaded on Dec. 9, 2003 from http://www.experts-exchange.com/Miscellaneous/Math_Science/Q_20764747.html, p. 1.

* cited by examiner

| JACKPOT | BASEVALUES |
|---|---|
| Mini | 20 |
| Maxi | 200 |
| Grand | 5000 |

TAKE OFFER OR CHOOSE ONE OF THE BOXES

| JACKPOT | BASEVALUES |
|---|---|
| Mini | 20 |
| Maxi | 200 |
| Grand | 5000 |

TAKE OFFER OR CHOOSE ONE OF THE BOXES

| JACKPOT | BASEVALUES |
|---|---|
| Mini | 20 |
| Maxi | 200 |
| Grand | 5000 |

TAKE OFFER OR CHOOSE ONE OF THE BOXES

| JACKPOT | BASEVALUES |
|---|---|
| Mini | 20 |
| Maxi | 200 |
| Grand | 5000 |

TAKE OFFER OR CHOOSE ONE OF THE BOXES

| JACKPOT | BASEVALUES |
|---|---|
| Mini | 20 |
| Maxi | 200 |
| Grand | 5000 |

TAKE OFFER OR CHOOSE ONE OF THE BOXES

BONUS GAME FOR GAMING MACHINE PROVIDING PLAYER WITH DEAL OR NO DEAL OPTIONS

FIELD OF THE INVENTION

This invention relates to games played on a gaming machine and, in particular, to a bonus game in a gaming machine, such as a slot machine.

BACKGROUND

A typical gaming machine found in casinos carries out a single game, such as displaying rotating reels having symbols, where the resulting symbol combinations correspond to awards to be paid to the player. Many newer gaming machines provide a bonus game as a reward for a special symbol combination, where the bonus game is different from the main game. This bonus game adds player excitement and, thus, results in a more popular and profitable gaming machine.

What is needed is a bonus game that further adds player excitement and keeps the player playing the gaming machine.

SUMMARY

A bonus game is described having direct player interaction so that the player feels responsible for the outcome of the bonus game.

In one embodiment, a gaming machine carries out a main game, such as a spinning reel type game, either using physical reels or simulated reels on a video screen. A special combination of symbols activates a video bonus game. In one embodiment, the bonus game displays a plurality of hidden objects in the form of icons. The objects may be credits, money, letters, symbols, or anything else.

In one embodiment, the icons represent credit awards. The player selects a first icon, where the value of the first icon remains hidden from the player. The player then chooses one or more additional icons, and the hidden values for the selected additional icons are revealed to the player. The player's goal is to win the highest value award.

After each selection of additional icons by the player, the gaming machine offers the player a value (e.g., a number of credits) to end the bonus game. If the player feels that her selected first icon value is greater than the offered value, the player will reject the offer and continue with the bonus game. Depending on the probabilities of the awards that the player may win as the bonus game progresses, the offers may go up or down. If the player accepts the offer, the offered amount is added to a credit meter or otherwise paid to the player.

If the player rejects all offers, the player wins the value of the first icon at the end of the bonus game.

In another embodiment, the icons represent letters. Various predetermined words that may be spelled have different values associated with them. The first word that the player spells grants that associated award to the player. The player is given an offer before each selection of an additional icon to end the game. The game ends when the player either takes the offer or spells a word.

Any other types of symbols may be used when accumulating combinations or sets of symbols to win an award.

In another embodiment, no offers are made to the player, and awards are granted for the completion of a word or the accumulation of other types of symbols.

Awards may include jackpots as well as fixed awards.

In one embodiment, the hidden objects (letters, credits, etc.) behind each displayed icon are displayed to the player in an order unrelated to the order of the hidden objects. In this way the player can determine the probabilities for winning the various possible awards when deciding to accept or reject the offer.

DETAILED DESCRIPTION

Although the invention can typically be implemented by installing a software program in most types of modern video gaming machines, one particular gaming machine platform will be described in detail.

Figure 1:
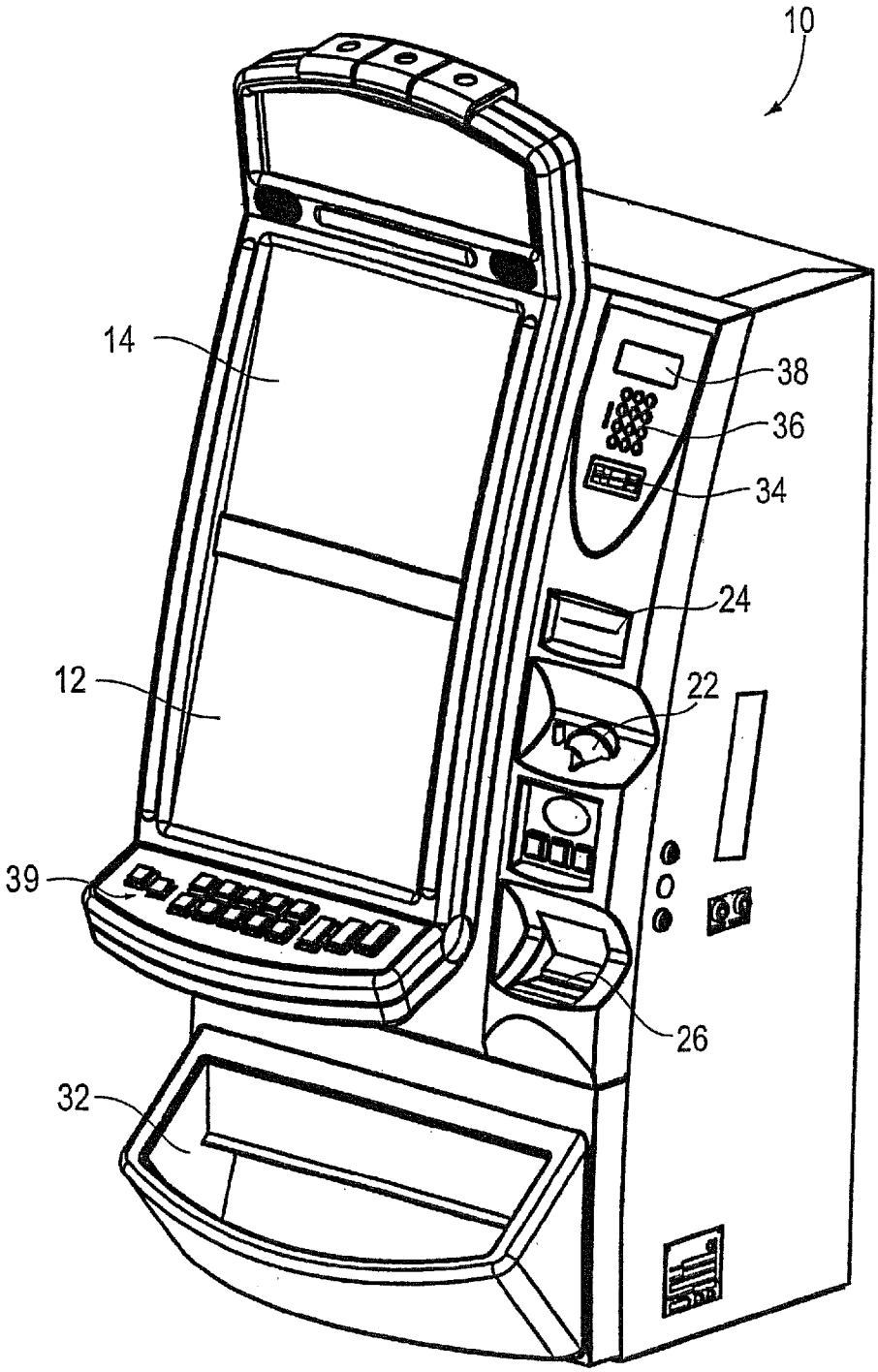
FIG. 1 is a perspective view of one type of gaming machine that may be programmed to carry out the inventive game.

FIG. 1 is a perspective view of a gaming machine 10 that incorporates the present invention. Machine 10 includes a display 12 that may be a thin film transistor (TFT) display, a liquid crystal display (LCD), a cathode ray tube (CRT), or any other type of display. A second display 14 provides game data or other information in addition to display 12. Display 14 may provide static information, such as an advertisement for the game, the rules of the game, pay tables, paylines, or other information, or may even display the main game or the bonus game along with display 12. Alternatively, the area for display 14 may be a display glass for conveying information about the game.

Display 12 or 14 may have a touch screen lamination that includes a transparent grid of conductors. Touching the screen changes the capacitance between the conductors, and thereby the X-Y location of the touch may be determined. The processor associates this X-Y location with a function to be performed. Such touch screens are very well known in the field of slot machines, and a detailed description of them is not required.

A coin slot 22 accepts coins or tokens in one or more denominations to generate credits within machine 10 for playing games. An input slot 24 for an optical reader and printer receives machine readable printed tickets and outputs printed tickets for use in cashless gaming. A bill acceptor 26 accepts various denominations of banknotes.

A coin tray 32 receives coins or tokens from a hopper upon a win or upon the player cashing out.

A card reader slot 34 accepts any of various types of cards, such as smart cards, magnetic strip cards, or other types of cards conveying machine readable information. The card reader reads the inserted card for player and credit information for cashless gaming. The card reader may also include an optical reader and printer for reading and printing coded barcodes and other information on a paper ticket.

A keypad 36 accepts player input, such as a personal identification number (PIN) or any other player information. A display 38 above keypad 36 displays a menu for instructions and other information and provides visual feedback of the keys pressed.

Player control buttons 39 include any buttons needed for the play of the particular game or games offered by machine 10 including, for example, a bet button, a repeat bet button, a play two-ways button, a spin reels button, a deal button, hold cards buttons, a draw button, a maximum bet button, a cash-out button, a display paylines button, a display payout tables button, select icon buttons, and any other suitable button. Buttons 39 may be replaced by a touch screen with virtual buttons.

Figure 2:
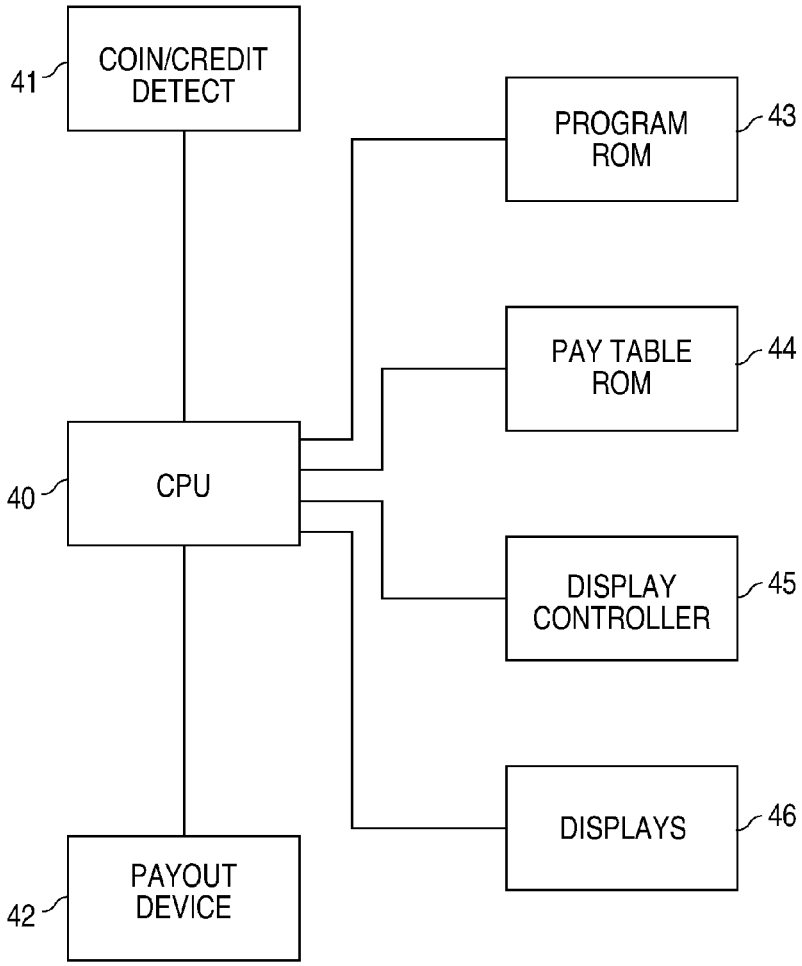
FIG. 2 is a functional block diagram showing the basic functional units in the gaming machine of FIG. 1.

FIG. 2 illustrates basic circuit blocks in a suitable gaming device. A control unit (CPU 40) runs a gaming program stored in a program ROM 43. A coin/credit detector 41 enables the CPU 40 to initiate a next game. A pay table ROM 44 detects the outcome of the game and identifies awards to be paid to the player. A payout device 42 pays out an award to the player in the form of coins upon termination of the game or upon the player cashing out. A payout may also be in the form of a coded paper ticket, credits on a smart card or magnetic strip card, or in any other form. A display controller 45 receives commands from the CPU 40 and generates signals for the various displays 46. If a display 46 is a touch screen, player commands may be input through the display screen into the CPU 40.

In one embodiment, the game described below is a bonus game that is initiated upon a special outcome of the main game displayed on machine 10 in FIG. 1. The main game may be the display of physical, motor-driven reels or a video simulation of motor-driven reels, where combinations of symbols across one or more pay lines are associated with awards to be granted to the player. Some symbol combinations pay credits as an award, and one or more other symbol combinations give rise to a bonus game. The main game may be displayed using any means. The main game may be any type of game and need not be limited to a symbol-type game. For example, if the main game is a card game, the bonus game may be activated after a particular hand is obtained, such as a full house or higher. Virtually any type of game may be played as the main game and any selected outcome of the main game may activate the bonus game. Such triggering events activating a bonus game are well known, and the hardware/software used to initialize the bonus game may be conventional.

FIGS. 3-14 are possible images displayed on display 14 or display 12 in FIG. 1 during operation of the bonus game after the main game has generated a particular outcome that automatically activates the bonus game. FIGS. 3-8 illustrate one type of bonus game, and FIGS. 9-14 illustrate an additional embodiment of a bonus game. The bonus game may be presented to the player on the same screen as the main game or on a different screen.

Figure 3:
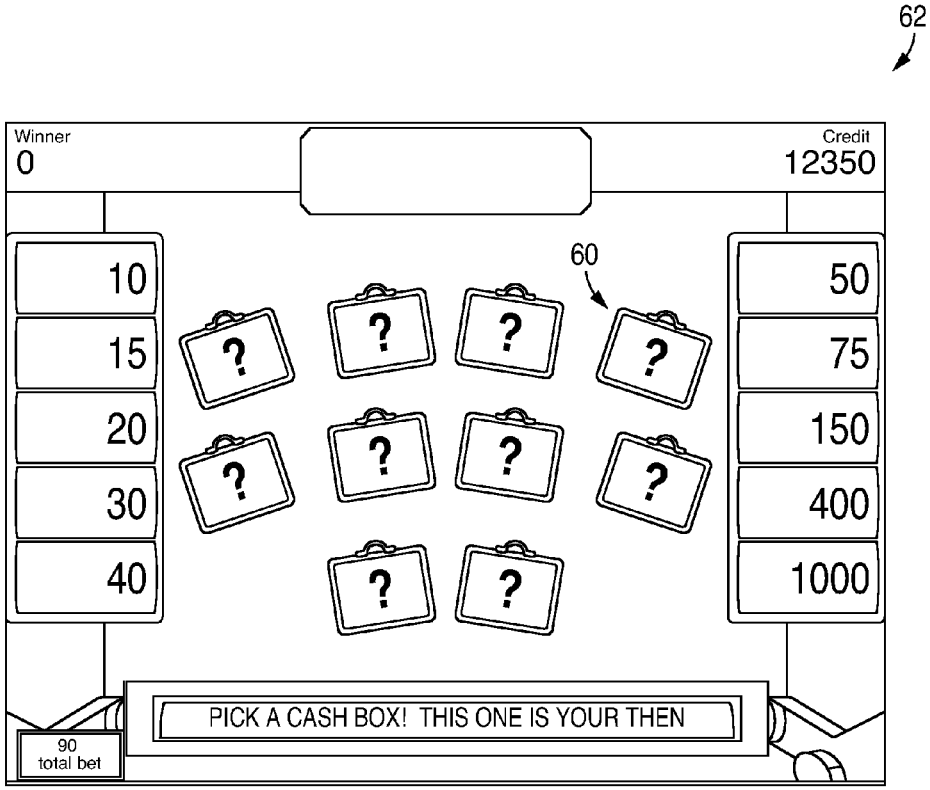
FIGS. 3-8 are successive displays on the display screen of the gaming machine of FIG. 1 as the deal or no deal game commences.

When the special combination is obtained in the main game, the screen of FIG. 3 is automatically displayed after an introductory screen for the bonus game. FIG. 3 illustrates ten cash boxes 60, where each cash box 60 represents a different number of credits. The credit value associated with each cash box 60 is unknown to the player. The various credit values hidden in the cash boxes 60 are displayed to the player as displayed values 62. In the present example, the credit values range from 10 to 1,000 credits.

The player is told to pick one of the cash boxes 60, and the player touches one of the cash boxes 60. In the preferred embodiment, the display screen of the gaming machine has a touch screen lamination, which is well known to those skilled in the art. Sensors throughout the lamination detect the X-Y position of the player's fingertip when it contacts the screen, and this position is correlated to a function associated with the image that the player has touched. Other types of touch sensitive devices may be used.

Figure 4:
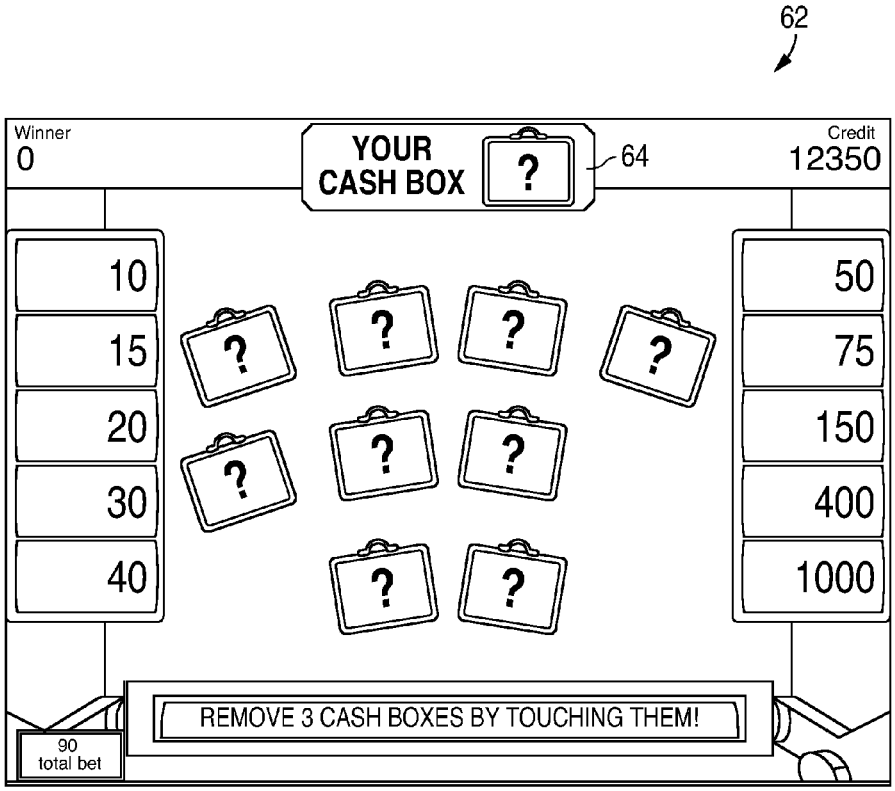

FIG. 4 illustrates the display screen after the player has selected one of the cash boxes 60, and the selected cash box 64, still with its hidden value, is set aside.

The screen of FIG. 4 also tells the player to remove three additional cash boxes by touching them. The player then touches three additional cash boxes and, as they are touched, the hidden values are displayed to the player and the selected cash boxes evaporate. The values in those cash boxes are then deleted from the displayed values 62, as shown in FIG. 5.

Figure 5:
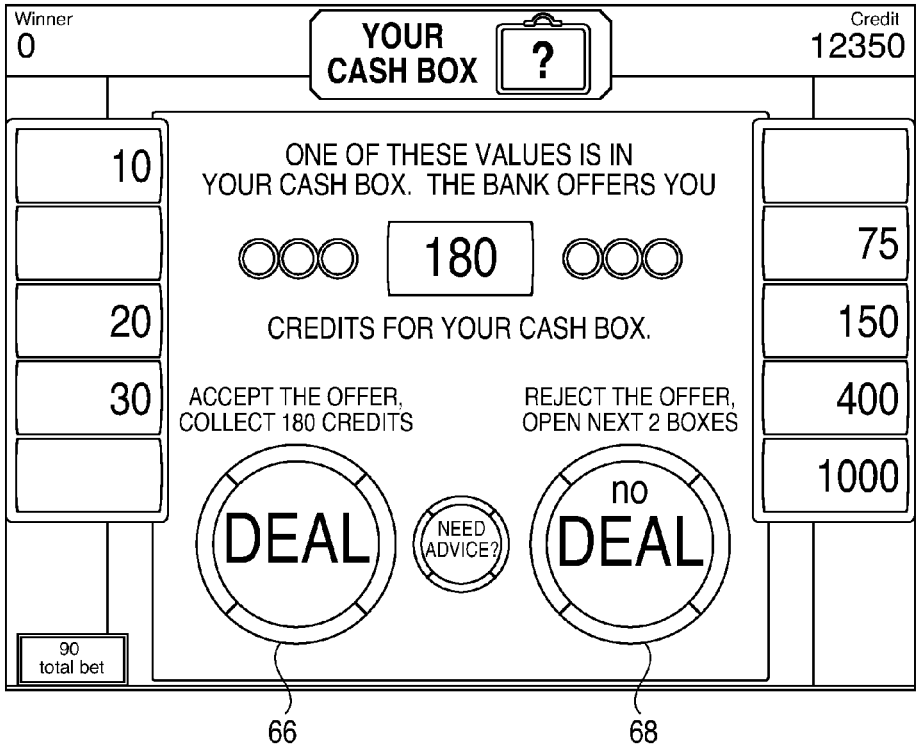

In the display screen of FIG. 5, the player is offered 180 credits, calculated based upon the remaining possible credit awards, to stop playing the bonus game. The player is invited to either take this deal or not take the deal by pressing the appropriate buttons 66 and 68. Had the player's first three selections of cash boxes included the 1,000, 400, and 150 value cash boxes, the deal would have been less than 180. The deal value is calculated such that is not clear to the player, based upon the remaining values, whether the deal is a very good deal or a very bad deal. It is assumed for purposes of this example that the player has pressed the no deal button 68 believing that either the 400 or 1,000 credit cash box was initially selected as cash box 64.

Figure 6:
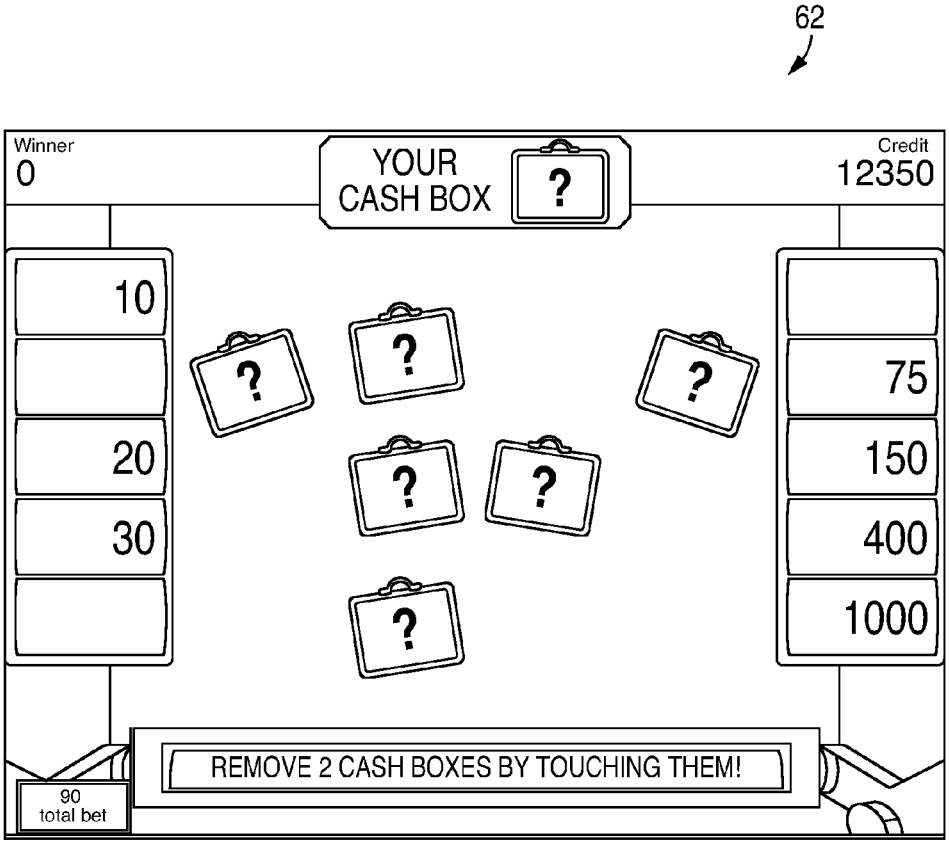
Figure 7:
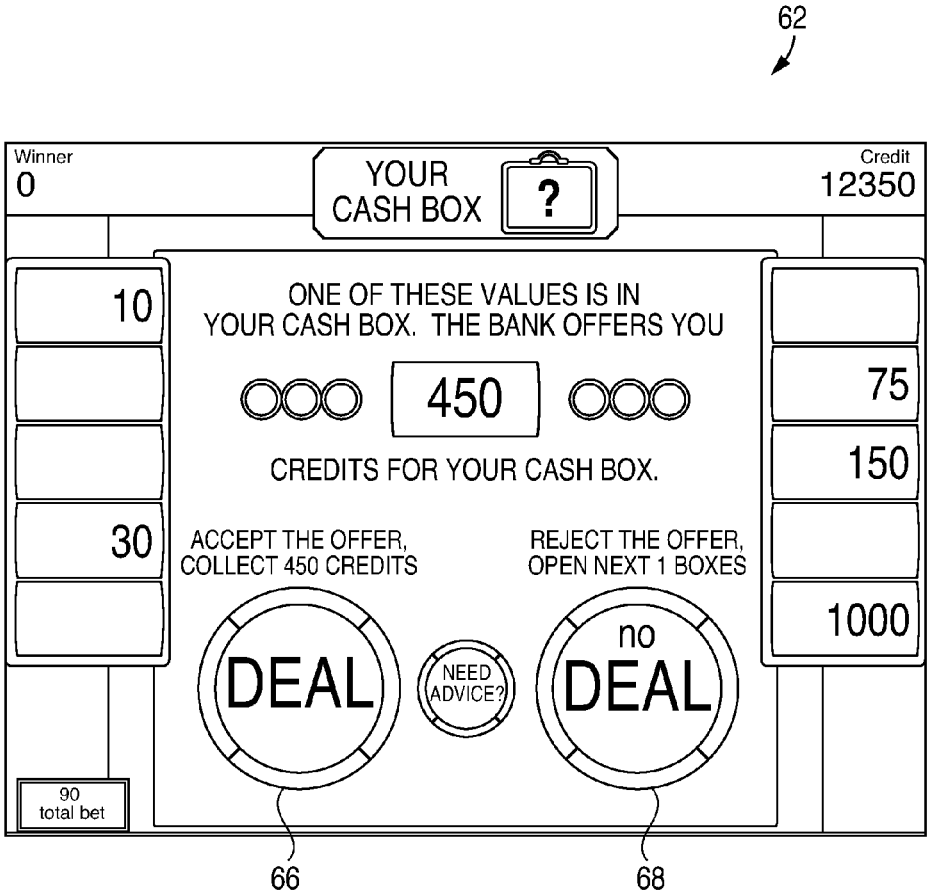

In FIG. 6, the player is told to remove two additional cash boxes 60 by touching them. After these two additional cash boxes 60 are selected, the hidden values are revealed, and these values are removed from the displayed values 62, as shown in FIG. 7.

In FIG. 7, the player is again presented with the deal or no deal option, where the offered amount is now 450 credits. The offered deal has gone up because there are fewer selections remaining, and one of the remaining cash boxes, including the one player initially chose, represents 1,000 credits. In the example of FIG. 7, the player has decided to take the deal by pressing the deal button 66.

Figure 8:
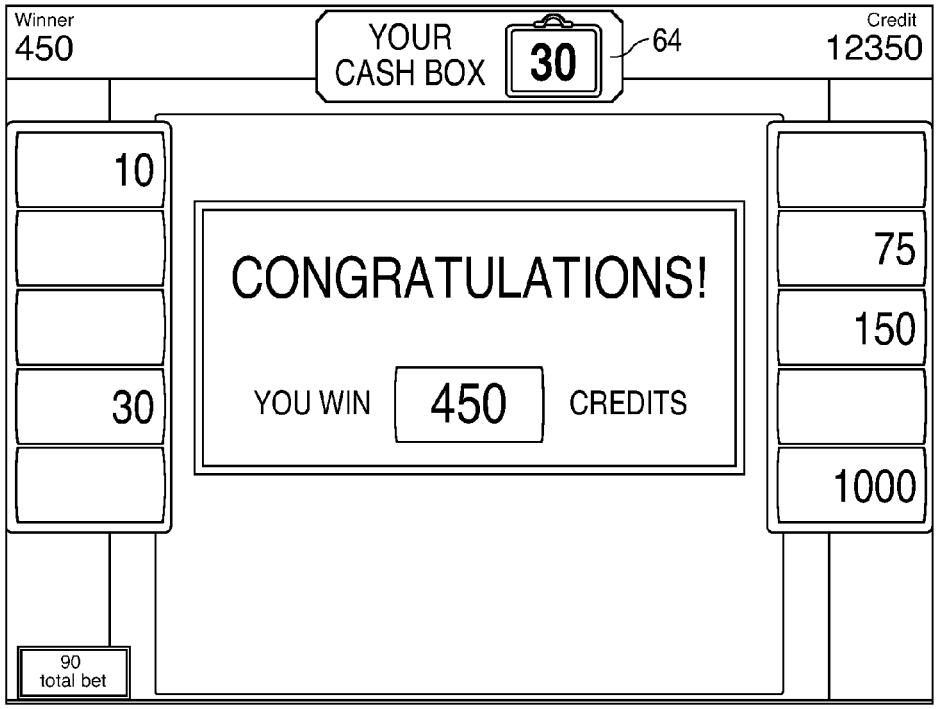

In response, as shown in FIG. 8, the offered credit value of 450 credits is awarded to the player, and the hidden value of the player's selected cash box 64 is revealed. In this particular case, the selected cash box 64 represented 30 credits, so the player made a very good choice by taking the deal. The player could have elected in FIG. 7 to reject the deal by pressing button 68, and the game would have continued until the player accepted another offer or there were no more cash boxes 60 remaining, in which case the player would have been awarded the value in the initially selected cash box 64.

After the bonus game, the gaming machine then automatically reverts back to its normal operation, where the player must place an additional bet in order to play the main game. The player then presses the suitable buttons to make a wager and to spin the reels, assuming the main game is a spinning reels type game.

A modification to this deal or no deal game is illustrated in FIGS. 9-14, where FIGS. 9-14 illustrate successive display screens for the bonus game.

Figure 9:
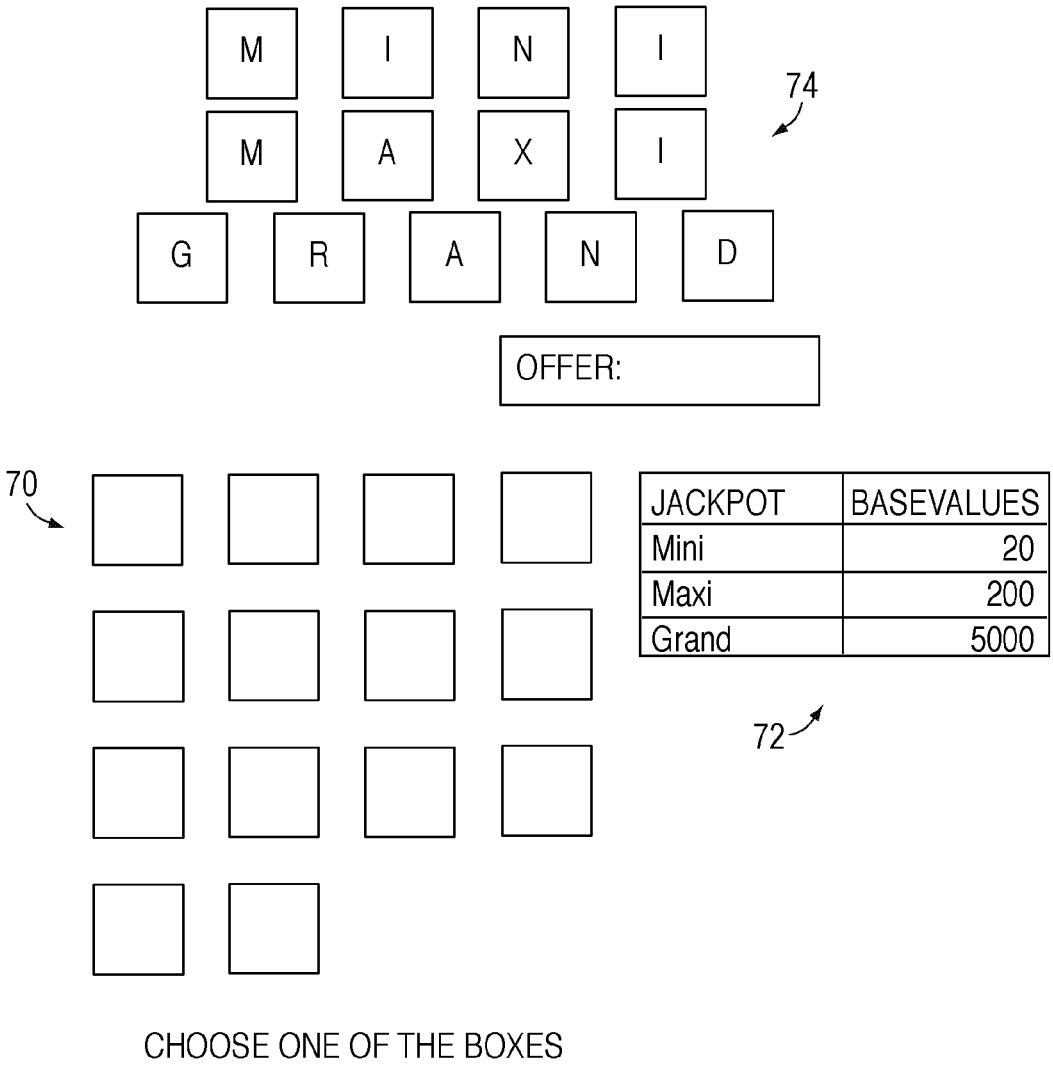
FIGS. 9-14 are possible successive display screens of a modified version of the deal or no deal game.

FIG. 9 illustrates the first screen of the bonus game after an introductory display screen. In this particular game, the player selects one of the boxes 70 in each round by touching the box. Each box 70 contains a letter. The awards for spelling different words are identified in the table 72. An additional table may be provided identifying the number of each type of letter in boxes 70. If the player first spells the word "MINI," the player wins 20 credits since this is the word most likely to be spelled first. If the player first spells the word "MAXI," the player wins 200 credits. If the player first spells the word "GRAND," the player wins the grand prize of 5,000 credits. The possible words to be spelled are shown in display area 74. The player is told to choose one of the boxes 70.

Figure 10:
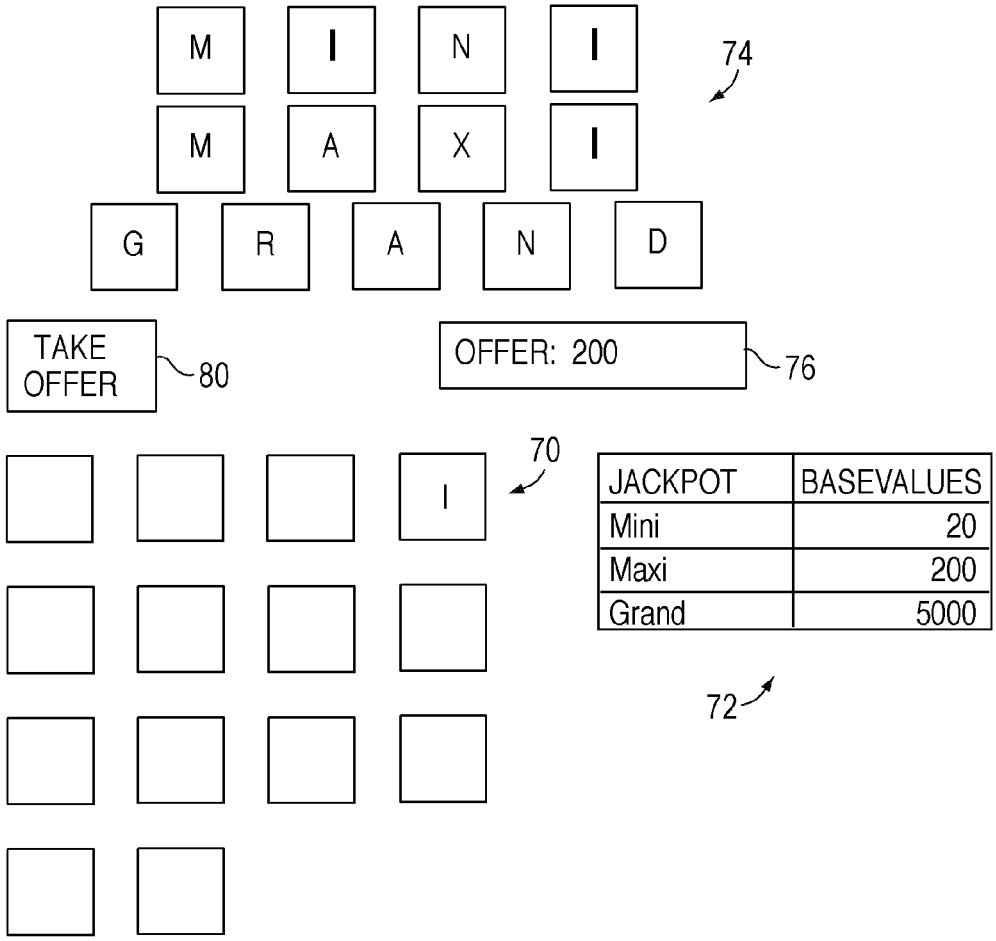

FIG. 10 illustrates that the player has touched a box 70 that reveals the letter I. The letter I is highlighted in the words MINI and MAXI in area 74. An offer of 200 credits is then made to the player within box 76 to quit the bonus game. The offer is based upon the current likelihood of the player spelling one of the three words first. For example, the offer may be determined based on the probabilities of certain letters being chosen multiplied by the base value of each award and summing all the awards, plus rounding.

Since the player's selection of the letter I made it more likely that the words MINI and MAXI will be spelled before the word GRAND is spelled, the offer is relatively low. The player is presented with a take offer button 80. The player is told to take the offer or choose another box 70. It is assumed in this example that the player has rejected the offer by selecting another box 70. In an alternative embodiment, the player may be presented with a reject offer button 78.

Figure 11:
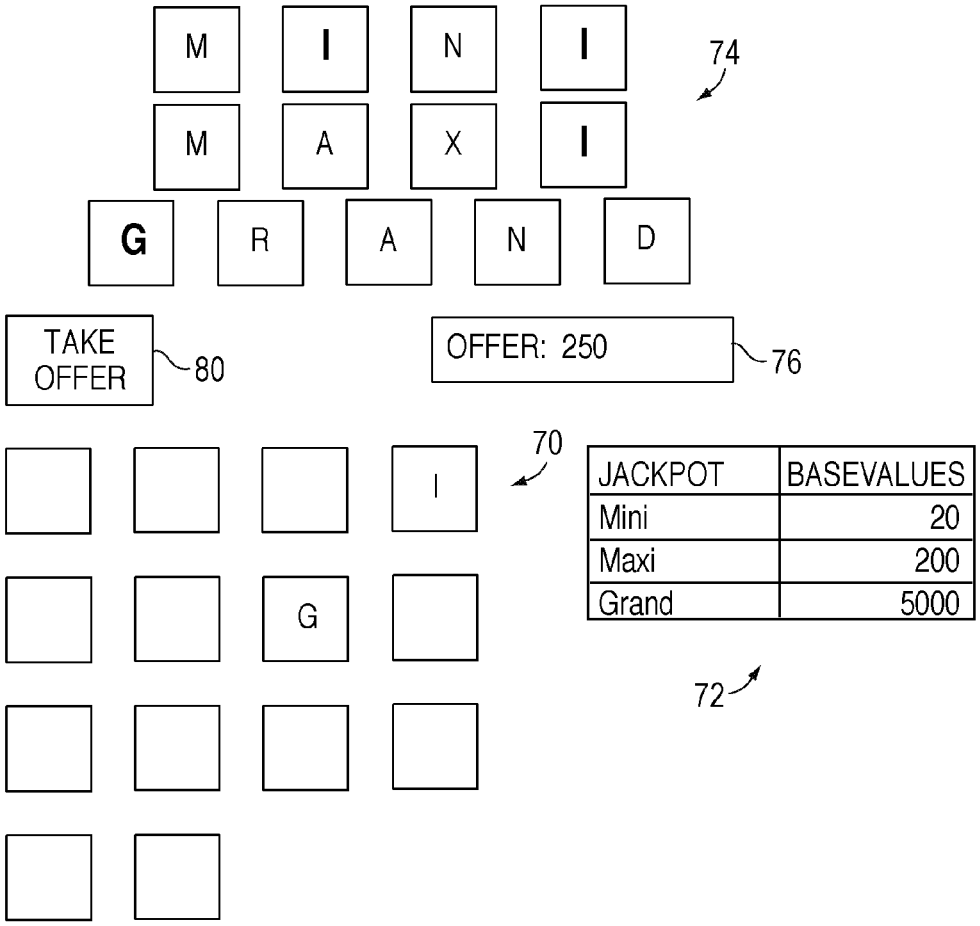

FIG. 11 illustrates that the player has touched a box 70 that reveals the letter G. The letter G in the word GRAND is now highlighted, and the offer is increased to 250 credits since the likelihood that the player will win the 5,000 credit grand prize has increased. It is assumed that the player has again rejected the offer by selecting another box 70.

Figure 12:
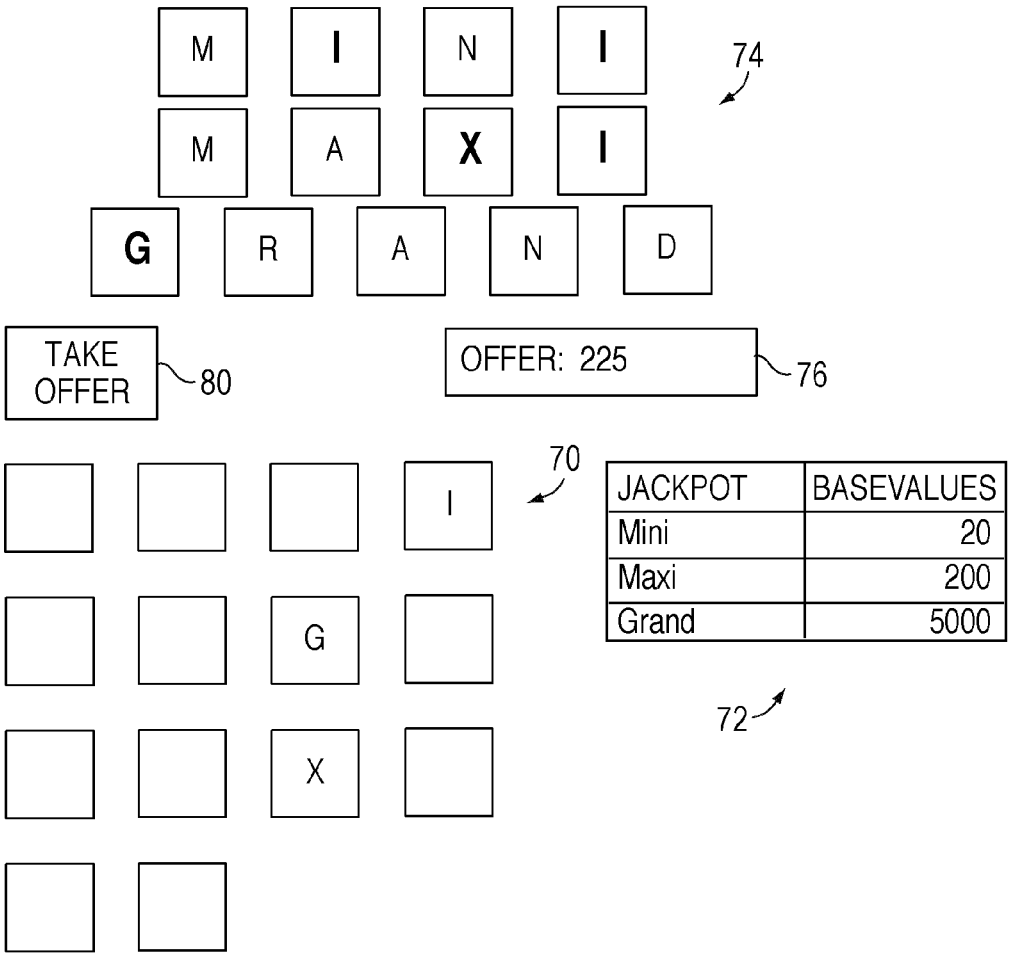

FIG. 12 illustrates that the player has touched a box 70 that reveals the letter X, and the X in MAXI is highlighted. The offer in box 76 has gone up slightly to 225 credits since it is less likely that the word MINI will be spelled first. It is assumed the player again rejected the offer by selecting another box 70.

Figure 13:
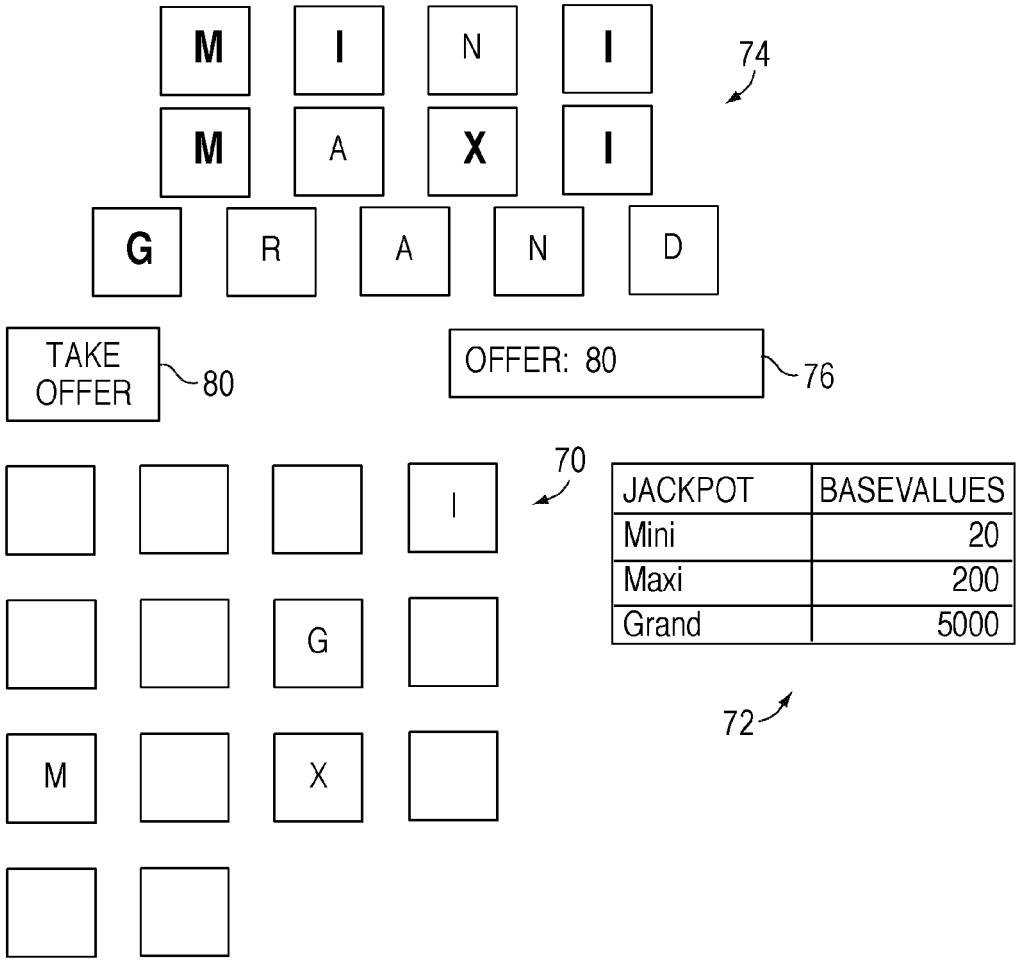

FIG. 13 illustrates that the player has touched a box 70 that reveals an M, and the M in MINI and MAXI is highlighted. The offer in box 76 has now gone down to 80 credits since it is most likely that the player will spell the word MINI (there are more N's than A's in boxes 70.). The player has again rejected the offer. Had the player touched the take offer button 80 in FIG. 13, the player would have won the offered amount of 80 credits.

Figure 14:
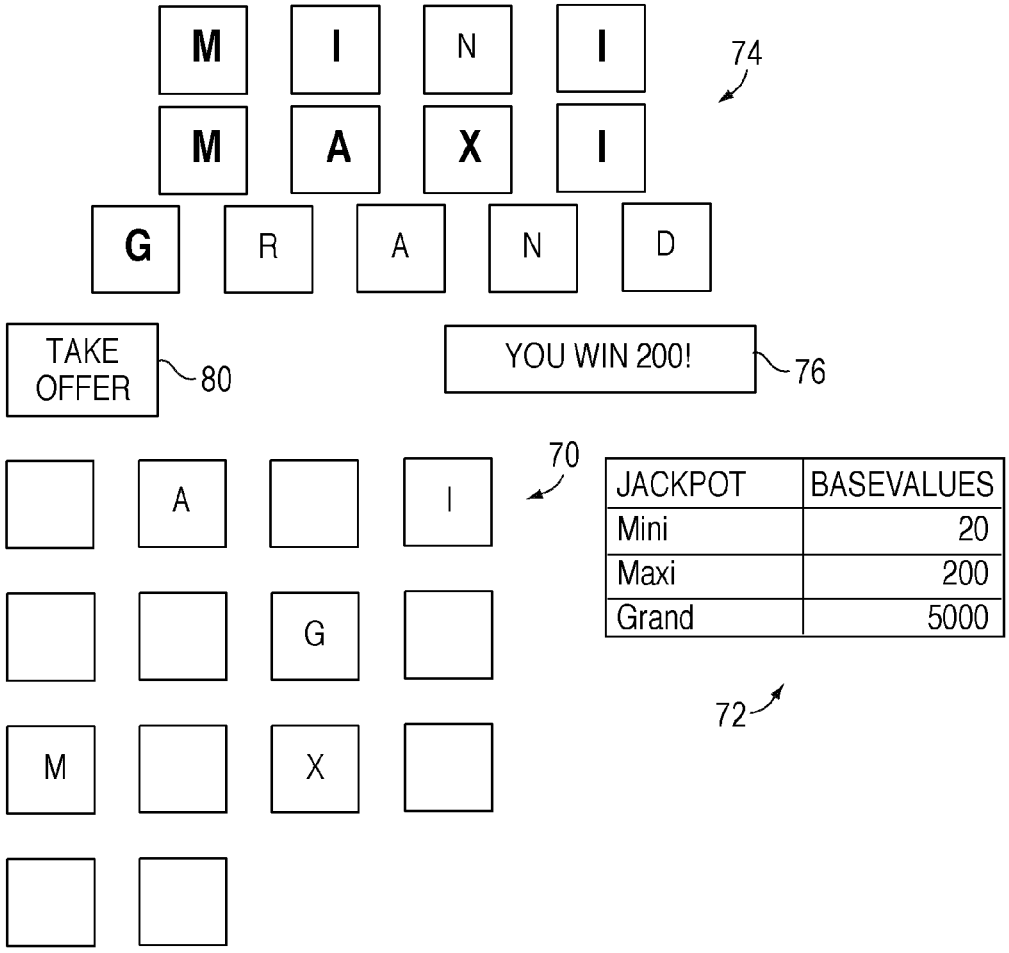

FIG. 14 illustrates that the player selected a box 70 that reveals the letter A. This spells the word MAXI, causing the player to win 200 credits, which is displayed in box 76. Once the bonus game is over, the credits are applied to the credit meter of the gaming machine, and the operation reverts back to the main game, in which the player typically wages a bet and spins reels or plays another game.

The number of letters of each type in boxes 70 is determined by the designer to achieve certain probabilities that a particular letter will be chosen. For example, having more M's and I's in the boxes 70 makes it more likely that MINI or MAXI will be spelled before GRAND.

Instead of the words having fixed values, the spelling of a word may award a certain progressive jackpot to the player. Any other type of award may be granted. There may be three or more progressive jackpots, each with a different average level determined by a different percentage allocation of the wagers.

In another embodiment, no offers are given to the player. The player just wins the amount associated with the first word spelled (or other type of game). The amount won may be a fixed amount, or a progressive amount, or some unknown amount. If numbers or other symbols are used, the player may win an amount based on accumulated symbols. For example, the player may win an amount based on the numbers selected before reaching a goal, such as collecting five ones. Many other type of games are envisioned.

The game of FIGS. 9-14 has been illustrated with specific values, boxes, words, and other features. It would be understood that any word may be spelled having any value, and any number of boxes may be used. It is not important that the hidden objects in boxes 70 are letters; such boxes may contain numbers, symbols or anything else. The selection of the boxes or any other type of icon is used to complete one or more patterns or sets having different award values, and offers are made to the player to quit the game or take the offered credits depending on how the bonus game is progressing for the player.

The various games described are easily implemented by a software programmer programming the game and suitable graphics into a memory, such as program ROM 43 in FIG. 2. The CPU 40 carries out the game, as will be understood by those skilled in the art.

The above-described game may be played as a main game instead of a bonus game. The game may be played on a stand-alone machine, or on a machine connected to a server, or on-line via the Internet, or on any device having a display and a processor, such as a telephone. All such devices may be considered gaming devices.

Having described the invention in detail, those skilled in the art will appreciate that, given the present disclosure, modifications may be made to the invention without departing from the spirit of the inventive concepts described herein. Therefore, it is not intended that the scope of the invention be limited to the specific embodiments illustrated and described.

What is claimed is:

1. A method for carrying out a game performed by a gaming device comprising:

a. displaying a first screen to a player showing a set of icons, each icon representing a hidden object that is not a numerical, monetary, or credit value;

b. displaying a plurality of predetermined combinations of objects along with an award value associated with each predetermined combination of objects prior to step f;

c. receiving a signal from the player selecting one or more of the icons;

d. displaying to the player the objects associated with each of the selected one or more icons;

e. automatically accumulating selected objects and displaying an accumulation of the selected objects to the player;

f. presenting the player with an offer of an award for ending the game and allowing the player to accept the offer or reject the offer based on the player's evaluation of the offer compared to the displayed award values for the predetermined combinations of objects;

g. if the gaming device has received a signal from the player accepting the offer, then granting the offered award to the player, and, if the player has not accepted the offer, then continuing to step h;

h. receiving a signal from the player selecting additional one or more icons from the set of icons and displaying to the player the objects associated with each of the selected additional one or more icons;

i. repeating steps e through h until the player has accepted the offer or has selected a certain number of icons from the set of icons; and j. if the player rejects all offers in step g throughout the game, granting an award to the player equal to the displayed award value for the predetermined combination of accumulated objects that matches a combination of objects accumulated during the game by the player's selection of icons.

2. The method of claim 1 wherein step i comprises repeating steps e through h until the player has accepted the offer or has selected all of the icons that the player is allowed to select during the game.

3. The method of claim 1 further comprising varying the offer based on a probability of an award being granted to the player if the player does not accept the offer.

4. The method of claim 1 wherein the icons represent letters, the method further comprising granting an award to the player based on a word spelled by letters accumulated during the game if the player rejects all offers.

5. The method of claim 4 wherein granting an award comprises granting an award based on a first word spelled by the accumulated letters.

6. The method of claim 5 wherein there are three possible words to spell for granting the award.

7. The method of claim 5 further comprising displaying to the player all letters represented by the set of icons.

8. The method of claim 1 further comprising granting to the player a fixed award after selecting a certain number of icons from the set of icons.

9. The method of claim 1 further comprising granting to the player a progressive jackpot award after selecting a certain number of icons from the set of icons.

10. A gaming device comprising:

a display;

a processor;

a memory; and a player selection input device;

the memory being programmed for controlling the processor to carry out the following method:

a. displaying a first screen to a player showing a set of icons, each icon representing a hidden object that is not a numerical, monetary, or credit value;

b. displaying a plurality of predetermined combinations of objects along with an award value associated with each predetermined combination of objects prior to step f;

c. receiving a signal from the player selecting one or more of the icons;

d. displaying to the player the objects associated with each of the selected one or more icons;

e. automatically accumulating selected objects and displaying an accumulation of the selected objects to the player;

f. presenting the player with an offer of an award for ending the game and allowing the player to accept the offer or reject the offer based on the player's evaluation of the offer compared to the displayed award values for the predetermined combinations of objects;

g. if the gaming device has received a signal from the player accepting the offer, then granting the offered award to the player, and, if the player has not accepted the offer, then continuing to step h;

h. receiving a signal from the player selecting additional one or more icons from the set of icons and displaying to the player the objects associated with each of the selected additional one or more icons;

i. repeating steps e through h until the player has accepted the offer or has selected a certain number of icons from the set of icons; and j. if the player rejects all offers in step g throughout the game, granting an award to the player equal to the displayed award value for the predetermined combination of accumulated objects that matches a combination of objects accumulated during the game by the player's selection of icons.

11. The device of claim 10 wherein step g comprises repeating steps e through h until the player has accepted the offer or has selected all of the icons that the player is allowed to select during the game.

12. The device of claim 10 further comprising varying the offer based on a probability of an award being granted to the player if the player does not accept the offer.

13. The device of claim 10 wherein the memory is further programmed to control the processor to display to the player various possible symbol combinations and awards for completing each symbol combination.

14. The device of claim 10 wherein the icons represent letters, and wherein the memory is further programmed to control the processor to grant an award to the player based on a word spelled by letters accumulated during the game if the player rejects all offers.

15. The device of claim 14 wherein the memory is programmed to control the processor to grant an award based on a first word spelled by the accumulated letters.

16. The device of claim 14 wherein there are three possible words to spell for granting the award.

17. The device of claim 14 wherein the memory is further programmed to control the processor to display to the player all letters represented by the set of icons.

* * * * *